US005752659A

United States Patent [19]

Moncelle

[11] Patent Number: 5,752,659

[45] Date of Patent: May 19, 1998

[54] DIRECT OPERATED VELOCITY CONTROLLED NOZZLE VALVE FOR A FLUID INJECTOR

[75] Inventor: Michael E. Moncelle, Bloomington, Ill.

[73] Assignee: Caterpillar Inc., Peoria, Ill.

[21] Appl. No.: 646,209

[22] Filed: May 7, 1996

[51] Int. Cl.[6] ..... F02M 47/02

[52] U.S. Cl. ..... 239/88; 239/124; 239/5

[58] Field of Search ..... 239/88–96, 124, 239/5; 123/446, 467; 251/30.01

[56] References Cited

U.S. PATENT DOCUMENTS

| | | | |
|---|---|---|---|
| 3,610,529 | 10/1971 | Huber | 239/96 |
| 4,412,657 | 11/1983 | Mowbray | 239/533.9 |
| 5,460,329 | 10/1995 | Sturman | 239/96 |
| 5,463,996 | 11/1995 | Maley et al. | 239/88 X |

FOREIGN PATENT DOCUMENTS

| | | | |
|---|---|---|---|
| 0017872 | 4/1980 | United Kingdom | 61/20 |
| 2 157 366 | 10/1985 | United Kingdom . | |
| 2289313 | 11/1995 | United Kingdom | 59/46 |

OTHER PUBLICATIONS

US Appl 08/438,858 filed May 10, 1995 Electronically Controlled Fluid Injector System Having Pre Injection Pressurizable Fluid Storage Chamber And Direct–Operated Check.

*Primary Examiner*—Andres Kashnikow
*Assistant Examiner*—Steven J. Ganey
*Attorney, Agent, or Firm*—Mark D. Becker; Michael B. McNeil

[57] ABSTRACT

The present invention provides direct control over the opening and closing of a fuel injector nozzle valve independent of fuel injection pressure or engine operating condition and allows for initial fuel injection rate shaping by controlling the opening velocity of the nozzle valve. The present invention further allows for control over the closing velocity of the nozzle valve thereby reducing stresses on the nozzle tip as the check engages the check seat while not adversely affecting the performance of the fuel injector. This results in lower tip wear and improved life of the fuel injector.

33 Claims, 2 Drawing Sheets

DIRECT OPERATED VELOCITY CONTROLLED NOZZLE VALVE FOR A FLUID INJECTOR

TECHNICAL FIELD

The present invention relates generally to fluid injectors and more particularly to a control apparatus within the fuel injector allowing for direct control over the actuation of the nozzle valve and hence the injection of the fuel and control over the opening and closing velocity of the nozzle valve.

BACKGROUND ART

Many electronically controlled fuel injectors utilize a pressure balanced nozzle valve within the nozzle portion of the fuel injector to control the injection of fuel into the combustion chamber of an internal combustion engine. The combination of a biasing spring and a fluid pressure balance acting across the nozzle valve controls the opening and closing of the check. This scheme for controlling the fuel injection nozzle valve is particularly useful in today's injectors in order to provide very rapid check closure to achieve a sharp fuel shutoff and thereby minimize emissions. The rapid closure of the nozzle valve has the disadvantage of increasing check closure velocity resulting in higher impact forces acting on the tip of the fuel injector. This disadvantage has been evidenced by increased tip wear in the area around the injection orifices.

In addition to very precise control over the end of the fuel injection sequence, stricter emission and noise standards virtually require the ability to tailor the shape of the initial fuel injection. What was needed was a nozzle valve control apparatus which provided control of the nozzle valve in both the opening and closing directions to satisfy todays strict emission requirements, but also reduced the tip impact stress to an acceptable level. The present invention is directed to overcoming one or more of the problems as set forth above.

DISCLOSURE OF THE INVENTION

In one aspect of the present invention, a fuel injector direct-operated nozzle valve control apparatus for controlling the injection of fuel into the combustion chamber of an internal combustion engine is disclosed. The control apparatus includes a housing having an injection orifice, a high pressure fuel source and a low pressure fuel source. The apparatus has a check which includes an upper end and a lower end adjacent the injection orifice. The check is movable in response to high pressure fuel between an open position allowing high pressure fuel communication with the orifices and a closed position blocking the communication. A high pressure fuel passage continuously communicates high pressure fuel to the check lower end and selectably communicates high pressure fuel to the check upper end. An actuating valve selectively communicates either high pressure fuel or low pressure fuel to the check upper end for directly controlling the timing and duration of the fuel injection independent of fuel supply pressure, fuel injection pressure or engine operating condition.

In another aspect of the present invention a method of injecting fuel into the combustion chamber of an internal combustion engine is disclosed. The method utilizes a fuel injector having an injector body and a check disposed in the injector body that is movable between injecting and non-injecting positions. A spring urges the check into the non-injecting position. The injector includes means coupled to the check ends for selectively coupling either high or low fluid pressures thereto. The method includes the steps of controlling the coupling means to cause the high fluid pressure to be applied to the check lower end and low fluid pressure to be applied to the check upper end. This provides for the spring to retain the check in non-injecting position. Thereafter the coupling means is controlled to cause the high fluid pressure to be applied to the upper check end while the high fluid pressure is being applied to the lower check end so that the check is moved to the injecting position against the urging of the spring. Thereafter, the coupling means causes the low fluid pressure to be applied to the upper check end while high fluid pressure is applied to the lower check end so that the check is moved to the non-injecting position in response to the urging of the spring.

In another aspect of the present invention a direct-operated check control apparatus includes a source of high pressure fluid, a low fluid pressure drain and a housing having an injection orifice. The control apparatus has a check being movable in response to high fluid pressure between an open position allowing high pressure fuel communication with said orifices and a closed position blocking communication with the orifices. A biasing means acts on the check to bias the check towards its closed position. An actuating means is included for controlling communication of the high fluid pressure thereby utilizing only the biasing means to retain the check in the closed position and utilizing only high fluid pressure to move the check to the open position.

The present invention provides control over the rate of opening and closing of the check. In this manner, the present invention allows for shaping the initial fuel injection rate and lowering the stresses on the nozzle tip at the end of injection while not adversely affecting the performance of the fuel injector. This results in engine exhaust gas emission control, lower tip wear and improved life of the fuel injector.

BEST MODE FOR CARRYING OUT THE INVENTION

Figure 1:
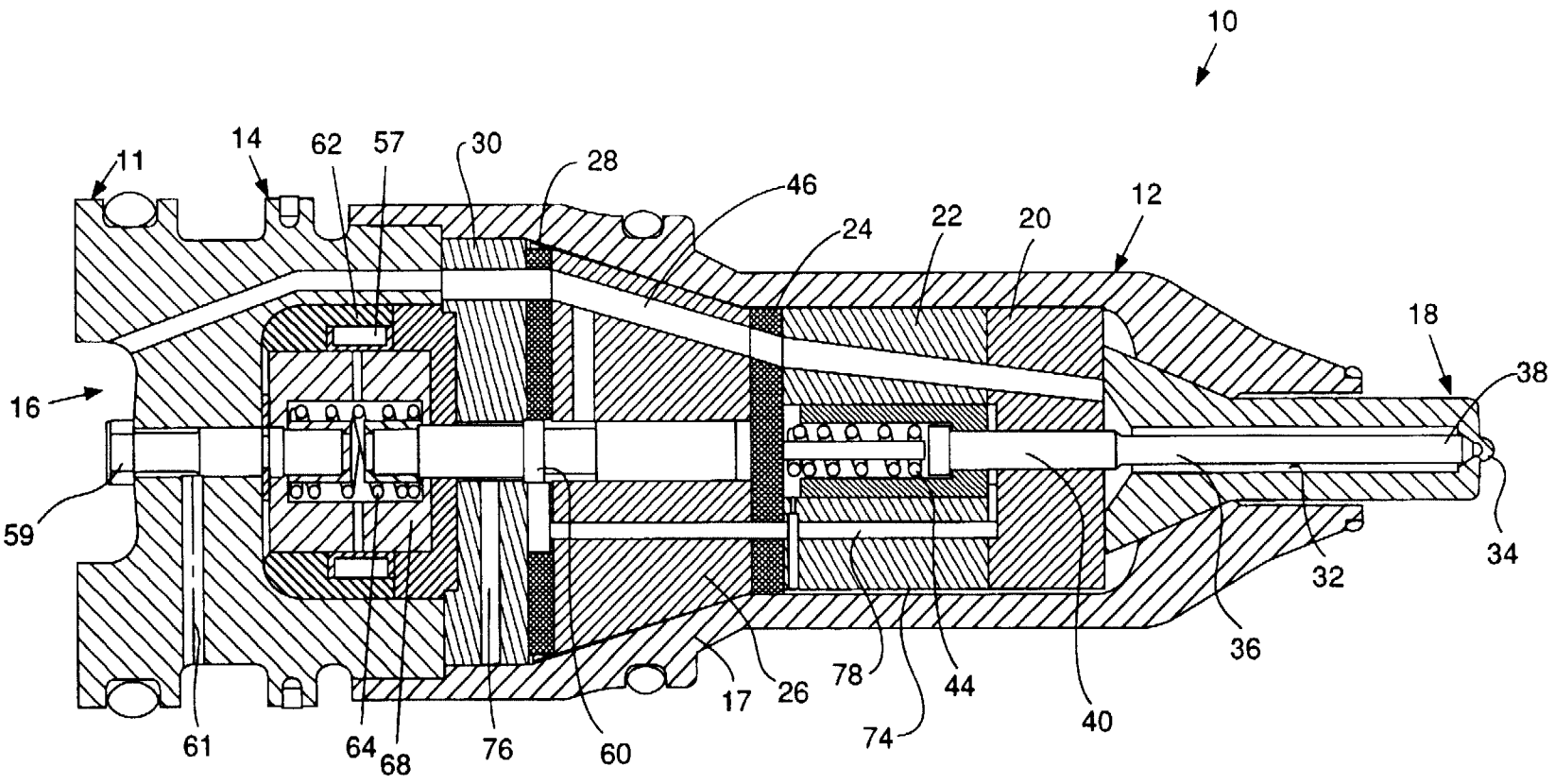
FIG. 1 is a diagrammatic partial cross-sectional view of the lower portion of a fuel injector showing one embodiment of the present invention nozzle valve control apparatus.
Figure 2:
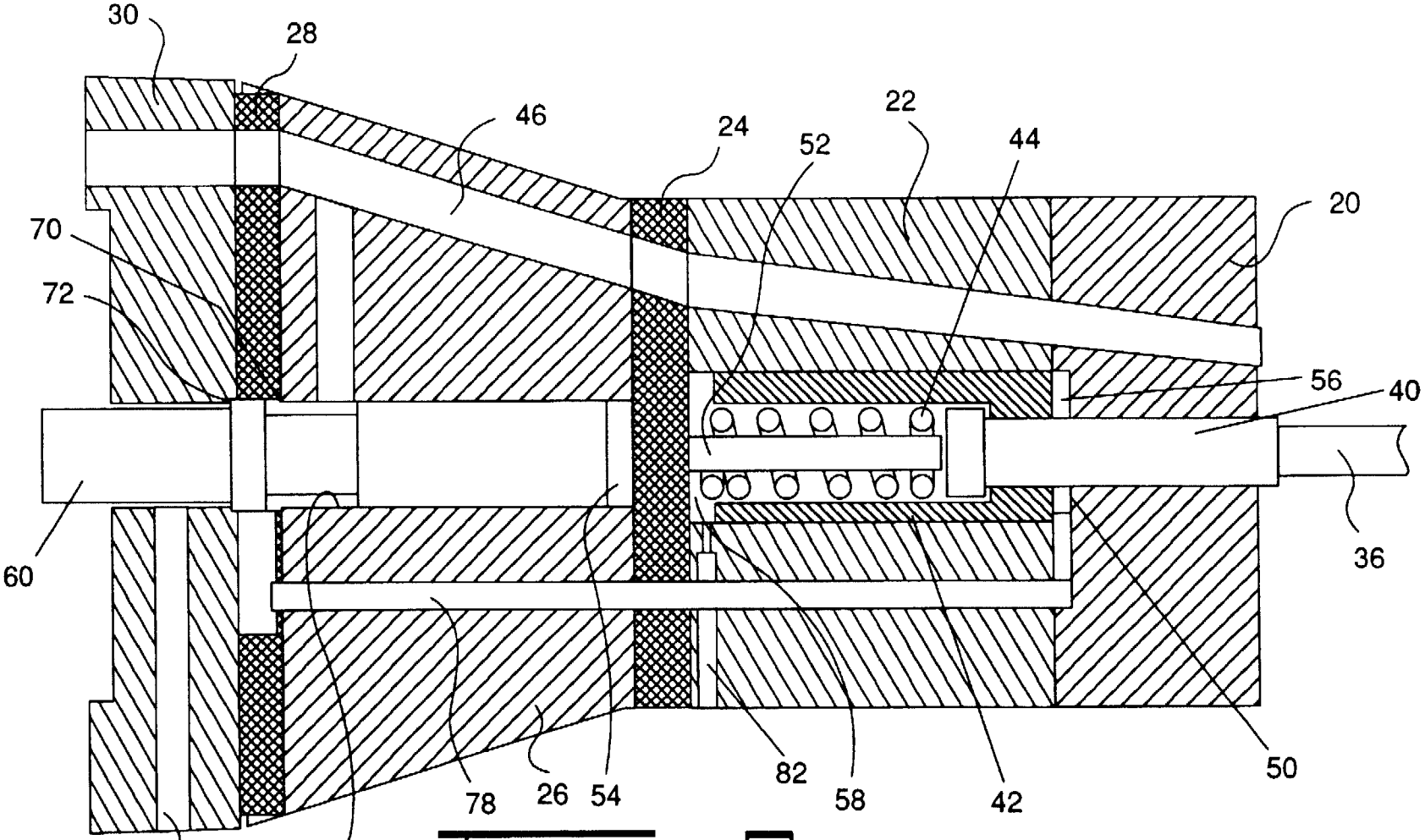
FIG. 2 is an enlarged diagrammatic partial cross-sectional view of the nozzle portion of a fuel injector showing one embodiment of the present invention nozzle valve control apparatus.

Referring to FIGS. 1 and 2, wherein similar reference numerals designate similar elements or features throughout the Figures, there is shown an embodiment of a fuel injector 10 of the present invention. The exemplary fuel injector 10 is shown in FIGS. 1–2 adapted for a electronically-controlled unit injector; however, it should be understood that the present invention is also applicable to other types of fuel injectors such as hydraulically-actuated electronically-controlled unit injectors, mechanically-actuated electronically-controlled unit pumps, or mechanically actuated fuel injectors.

The engine fuel system preferably includes an electronic control module which controls 1) the fuel injection timing, 2) the total fuel injection quantity during an injection cycle, 3) the fuel injection pressure, 4) the number of separate injections or injection segments during an injection cycle, 5) the time interval(s) between the injection segment(s), 6) the fuel quantity of each injection segment during an injection cycle; and 7) any combination of the above parameter(s)

between a plurality of injectors 10. Each of the above parameters are variably controllable independent of engine speed and loading.

Preferably, each injector 10 is a unit injector wherein both a fuel pressurization device and a fuel injection device are housed in the same unit. Although shown here as a unitized injector 10, alternatively, the injector could be of a modular construction with the fuel injection device positioned separate from the fuel pressurization device.

Referring now to FIGS. 1 and 2, the fuel injector 10 includes a body portion 11, a nozzle portion 12 and an actuating portion 14. The body portion 11 includes a reciprocal fuel pressurization member 15, preferably a mechanically-actuated plunger and tappet arrangement, (not shown) and defines an integral fuel storage chamber 16.

The nozzle portion 12 includes a housing 17 with a longitudinal bore of varying diameters for retaining a tip 18, a body guide 20, a check guide 22, a lower stop 24, a lower valve body 26, a poppet spacer 28 and an upper stop 30. The upper portion of the housing 17 includes internal threads for attaching and retaining the nozzle portion 12 to the actuating portion 14.

The tip 18 further includes a longitudinal bore 32 and at least one injection orifice 34. The nozzle portion 12 further includes a check 36 having a lower end portion 38 and an upper end portion 40, a check lift piston 42 and a biasing spring 44. The upper stop 30, poppet spacer 28, lower valve body 26, lower stop 24, check guide 22, and body guide 20 each include a longitudinal extending bore which forms a high pressure fuel passage 46 to communicate high pressure fuel from the fuel storage chamber 16 to the longitudinal bore 32 surrounding the check lower end portion 38.

The check 36 is movable between a first position blocking fluid communication between longitudinal bore 32 and the fuel injection orifice 34 and a second position opening fluid communication between the longitudinal bore 32 and the fuel injection orifice 34.

The check upper end portion 40 extends through the body guide 20 and into a check lift chamber 50 included within the check guide 22. The check upper end portion 40 is in close fit tolerance with the body guide 20 to prevent fuel leakage from the high pressure fuel passage 46 into the check lift chamber 50. The biasing spring 44 is located within the check lift chamber 50 and positioned to act upon the check upper end portion 40 thereby biasing the check towards the injection orifices 34 located in the tip 18. Also located within the check lift chamber 50 is a stop pin 52 positioned to determine the upward most position of the check 36. A check lift piston 42 is located within the check lift chamber 50 and positioned such as to act upon the check upper end portion 40 under fuel pressure. The check lift piston 42 divides the check lift chamber 50 into a lower check lift chamber 56 and an upper check lift chamber 58. The check lift piston 42 is in tight fit clearance with the check lift chamber 48 to prevent the leakage of fuel between the lower and upper check lift chambers 56, 58.

The actuator portion 14 includes an actuating means 57, a first electronically controlled pressure control valve 59, and a second electronically-controlled pressure control valve 60. The actuation means 57 is provided for controlling the position of the first and second valves 59, 60. The actuation means 57 is selectively de-energized or energized. For example, the electrical actuation means 57 may include a single solenoid or a plurality of solenoids. Alternatively, the means 57 may include a piezoelectric device. The first valve 59 is preferably positioned in the storage chamber 16 and selectively movable between a de-energized first position and an energized second position. At its first position, the first valve 59 opens fluid communication between the storage chamber 16 and the transverse fuel supply passage 61. The first valve 59 is energized to move from its first (opened) position to its second (closed) position. At its closed position, the first valve 59 blocks fluid communication between the storage chamber 16 and the transverse fuel supply passage 61.

In the embodiment shown, the pressurization member 15, preferably a plungers is positioned in the storage chamber 16 and is selectively movable between a first position and a second position. When the first valve 59 is opened (i.e., its first position), the plunger 15 is operable during movement from its first to second positions for displacing a first variably-selected volume of fuel from the storage chamber 16 to the transverse fuel drain passage 76. When the first valve 59 is closed (i.e., its second position) the plunger 15 is operable during movement from its first to second positions for displacing a second variably-selected volume of fuel in the storage chamber 16 thereby pressurizing such fuel to a selected variable pressure. Stated differently, after the first valve 59 is closed, the plunger 15 compresses the fuel to a controlled volume which is less than the fixed volume. Plunger actuation is preferably chosen to begin movement of the plunger 15 from its first to second positions before initial fuel injection begins in an injection cycle. This provides a variably selected injection pressure at the beginning of injection. In order to increase the mean effective injection pressure produced by the injector 10, the plunger actuation is preferably chosen to continue moving the plunger 15 from its first to second positions during fuel injection of an injection cycle. Alternatively the plunger actuation can be chosen to complete movement of the plunger 15 from its first to second positions prior to initial fuel injection of an injection cycle.

The second valve 60 is selectively movable between a de-energized first position and an energized second position. Preferably, the second valve 60 is a three-way valve such as a poppet valve or spool valve. In the embodiment shown in FIGS. 1 and 2, the second valve is a poppet valve 60 movable between a first de-energized position and a second energized position. Preferably the actuating means 57 includes a solenoid 62, a solenoid return spring 64, and an armature 68. The solenoid return spring 64 biases both the first and second valves 59, 60 towards their respective first positions.

The poppet valve 60 is located within a poppet bore 66, the bore extending through the lower valve body 26, the poppet spacer 28, and the upper stop 30. The poppet valve 60 is in tight tolerance fit with the poppet bore 66 to prevent high pressure fuel leakage during pressurization of the storage chamber 16 and during fuel injection. The poppet valve 60 is normally de-energized and is held in the first or down position against the sealing seat 70 in the lower valve body 26 by the solenoid return spring 64 acting on the armature 68. When the solenoid 62 is electronically energized the poppet 60 will move to a second position where the poppet 60 will engage the injection seat 72 in the upper stop 30. The poppet spacer 28 is used to control the total poppet valve 60 motion between the sealing seat 70 and the injection seat 72.

The fuel injector 10 also includes a low pressure fuel passage or fuel drain 74. The upper stop 30 includes a transverse passage 76 which connects the poppet bore 66 to the low pressure fuel passage 74. The poppet spacer 28, lower valve body 26, the lower stop 24 and the check guide 22 include connecting bores to form a control passage 78 to allow for fluid communication between the poppet bore 66 and the lower check lift chamber 56. The lower poppet chamber 54 formed by the lower stop 24 and the end of the poppet 60 is also connected to the low pressure fuel passage 74 through an orifice in the lower stop (not shown).

A first restricting means 80 is included within the control passage 78 to restrict the fluid flow between the high pressure fuel passage 46 and the lower check lift chamber 56. The first restricting means also restricts the flow of fluid between the control passage 78 and the low pressure fuel drain 74. The first restricting means 80 could be formed by placing an orifice or venturi within the control passage 78 or by utilizing a combination of the poppet valve 60 and the injection and sealing seats 72, 70. By adjusting the lift of the poppet valve 60 from the respective seats, 70 and 72, the desired fluid flow rate in and out of the lower check lift cavity 56 can be achieved. Either a flat seat sealing design or a conical seat sealing design can be utilized on the injection seat 72 since clearance between the diameter of the poppet valve and the upper stop 30 is needed to provide fluid flow out of the control passage 78 to the low pressure fuel passage 74. The clearance provided between the poppet valve 60 and the upper stop 30 can be adjusted to act as an element of the first restricting means 80. Utilizing a flat seat design on the injection seat 72 also allows for easier assembly of the nozzle portion of the injector 10 since the components can be dropped vertically in place and the alignment of the poppet valve 60 and the lower valve body 26 do not have to be as tightly controlled.

The upper check lift chamber 58 is vented to the low pressure fuel passage 74 through a check lift damping port 82. This damping port 82 prevents the buildup of pressure in the upper check lift chamber 58 and allows any fuel which leaks around the check lift piston 42 from the lower check lift piston 56 to drain. The check lift damping port 82 further includes a second restricting means 84 for restricting fuel communication between the upper check lift chamber 58 and the fuel drain 74. The second restricting means 84 can be achieved by utilizing an orifice or venturi within the damping passage 82.

INDUSTRIAL APPLICABILITY

Now the operation of the present invention will be discussed as incorporated into the embodiment of FIG. 1. Operation of the present invention would be very similar if utilized in an other type of fuel injector or fuel pump such as a mechanically-actuated electronically-controlled unit pump or a hydraulically-actuated, electronically controlled unit injector.

In operation, before an injection cycle begins, the solenoid 62 is normally de-energized so that the first valve 59 is opened and the second valve 60 is at its first position so as to engage the sealing seat 70. The check 36 is at its first (closed) position. The opened first valve 59 allows the fuel storage chamber 16, the high pressure fuel passage 46, and the longitudinal bore 32 to be filled with relatively low pressure fuel through the transverse fuel supply passage 61.

The plunger 15 begins its stroke from its retracted first position At a selected amount of plunger stroke, the solenoid 62 is energized causing closure of the first valve 59 and movement of the second valve 60 to its second position allowing fuel communication from the storage chamber 16 with the lower check lift chamber 56. The solenoid 62 preferably remains energized until the fuel pressure in the storage chamber 16 reaches a level sufficient to hydraulically hold the first valve 59 closed. The solenoid 62 is then de-energized allowing the solenoid return spring 64 to return the second valve 60 to its first position. The fuel pressure in the storage chamber 16, the high pressure fuel passage 46, and the longitudinal bore 32 continues to increase to a variably selected pressure due to continued stroking of the plunger 15. With the second valve 60 at its first position engaging the sealing seat 70, high pressure fuel communication with the control passage 78 and the lower check lift chamber 56 is blocked and the force of the biasing spring 44 acting on the check upper end portion 40 prevents the check 36 from opening. If the actuation means 57 included separate solenoids for the actuation of valves 59 and 60, then actuation of the second control valve 60 can be independently controlled by solenoid 62.

To start injection, the solenoid 62 is again energized thereby moving the second valve 60 to its second position. This closes the injection seat 72 of the upper stop 30 and opens the sealing seat 70 of the poppet spacer 28 communicating the high pressure fuel passage 46 with the control passage 78. By allowing high pressure fuel communication with the control passage 78, high pressure fuel acts on the check lift piston 42 and thereby on the check upper end portion 40 and the check 36 opens to begin fuel injection through the injection orifice(s) 34.

To end fuel injection, the solenoid 62 is again de-energized, moving the second valve 60 back to its first position and closing the sealing seat 70 to block fluid communication between the high pressure fuel passage 46 and the control passage 78. Moreover, the injection seat 72 is opened communicating the control passage 78 and the lower check lift chamber 56 with the low pressure fuel passage 74 thereby introducing low pressure fuel back into the lower check lift chamber 56.

Preferably, the upper and lower check end portions 38, 40 are sized such that when the check 36 is opened and the second valve 60 is at its first position, the net hydraulic forces acting on the check 36 are effectively zero. When the check 36 is opened, the force of the biasing spring 44 is preferably the only unbalanced force acting on the check 36, consequently biasing the check 36 toward its first (closed) position. At the end of a fuel injection cycle or injection segment, the force of the biasing spring 44 urges the check 36 from its opened position to its closed position at a selected velocity. The biasing spring force is preferably chosen to be sufficiently high for adequate check response yet sufficiently low to gently move the check 36 toward the tip 18 so that the check 36 does not over stress the tip 18 upon initial contact. Advantageously, the end of fuel injection during an injection cycle or segment is more precisely controlled since the velocity of the check 36 in the closing direction is primarily determined only by the force of the spring 44 with minimal affect by the fuel injection pressure.

Check opening and closing velocity is controlled by the biasing spring 44, the diameter of the check lift piston 42, and the volume and of the control passage. To allow for additional control over the opening and closing velocity of the check 36, the present invention utilizes first and second restriction means 80, 84 to act as a hydraulic damper to the movement of the check 36.

At the start of injection, the second valve 60 moves from its first position to its second position thereby allowing high pressure fluid communication with the control passage 78 and the first restricting means 80. The first restricting means acts to restrict the fluid flow to the lower check lift cavity 56. The amount of restriction is directly proportional to the time required to build pressure within the lower check lift chamber to a sufficient level to overcome the biasing spring 44 and to open the nozzle valve 36. By being able to control the force acting on the check upper end portion 40, applicant is able control the acceleration force and thereby the opening velocity of the check 36.

The opening velocity is also controllable by varying the second restricting means 84. As the check piston moves from its bottom most position, prior to injection, to its upper most position during fuel injection, the fluid in the upper check lift cavity 58 is vented to the low pressure passage 74 via the damping port 82. By varying the second restricting means 84 in the damping port 82, the force acting to prevent the check 36 from moving from its closed position to its open position can be varied. A combination of the first and second restricting means allows the present invention to adjust the rate of increase of the nozzle valve opening force acting in the lower check lift chamber 56 and the rate of nozzle valve closing force in the upper check lift chamber 58. Restated, the check opening velocity, and hence the fuel injection rate, can be shaped through hydraulic forces alone.

At the end of injection, when the check 36 is moving from the open position to the closed position, the check velocity can be controlled by the first restricting means 80. The first restricting means acts to prevent the decay of the pressure within the lower check lift chamber 56. The prevention of the lower check lift pressure decay acts as a hydraulic damper to slow the closing rate of the check 36 and thereby reduce the impact stresses on the tip 18.

The second restricting means 84 also can be utilized to control the check velocity in the closing direction. As the check lift piston 42 moves from its upper most position during fuel injection to its lower most position at the end of injection, the upper check lift chamber 58 is expanded. During this expansion, the pressure within the upper check lift chamber 58 tends to drop thereby reducing the force acting to move the check 36 to its closed position. By varying the amount of restriction in the check damping port 82, the second restricting means will prevent the venting of the upper check lift chamber 58 to the drain passage 74. A large restriction will tend to create a vacuum affect in the upper check lift chamber and thereby will act to reduce the check closing velocity If the second restricting means is minimized, the upper check lift chamber 58 will freely vent and the only force acting to close the check 36 will be the biasing spring 44. Hence the velocity of the check in the closing direction is controlled by the biasing spring preload and spring rate and the restriction of the first and second restricting means 80, 84.

Other aspects, objects, and advantages of this invention can be obtained from a study of the drawings, the disclosure, and the appended claims.

I claim:

1. A fuel injector direct-operated nozzle valve control apparatus for controlling the injection of fuel into the combustion chamber of an internal combustion engine, comprising:

a housing having an injection orifice;

a high pressure fuel source;

a low pressure fuel source;

a check including an upper end and a lower end adjacent said injection orifice, said check being movable in response to high pressure fuel between an open position allowing high pressure fuel communication with said injection orifice and a closed position blocking said communication with said injection orifice;

a high pressure fuel passage continuously communicating said high pressure fuel to said check lower end and selectably communicating high pressure fuel to said check upper end; and an actuating valve for selectively communicating high pressure fuel to said check upper end or low pressure fuel to said check upper end for directly controlling the timing and duration of the fuel injection independent of fuel supply pressure, fuel injection pressure or engine operating condition.

2. The fuel injector direct-operated nozzle valve control of claim 1 further including a biasing spring acting on said check to bias said check towards said closed position.

3. The fuel injector direct-operated nozzle valve control of claim 1 wherein said actuating valve is a poppet-type valve.

4. The fuel injector nozzle valve control of claim 1 further including a check stop positioned to limit check movement and define the open position of said check.

5. The fuel injector nozzle valve control of claim 1 further including a check lift piston acting on said check upper end to move said check from said closed position to said open position when said actuating valve allows communication of said high pressure fuel to said check upper end.

6. A fuel injector nozzle valve velocity control apparatus, comprising:

a housing having an injection orifice;

a high pressure fuel source;

a check including an upper end and a lower end adjacent said injection orifice, said check being movable in response to said high pressure fuel between an open position allowing high pressure fuel communication with said injection orifice and a closed position blocking said communication with said injection orifice;

a low pressure fuel passage;

a high pressure fuel passage communicating high pressure fuel to said check lower end and selectably communicating high pressure fuel to said check upper end; and an actuating valve selectively movable between a sealing position and an injecting position for selectively communicating said high pressure fuel passage to said check upper end or said low pressure fuel passage to said check upper end, said actuating valve at its injecting position including a first flow area restriction for controlling the rate of fuel pressure change to said check upper end.

7. The fuel injector direct-operated nozzle valve control of claim 6 wherein said actuating valve is a poppet valve and includes an injection seat and a sealing seat, said injection seat being a flat seat seal.

8. The fuel injector direct-operated nozzle valve control of claim 7 wherein said first flow area restriction is determined by the diametrical clearance around said poppet valve and is variable by controlling said diametrical clearance.

9. The fuel injector direct-operated nozzle valve control of claim 7 wherein said first flow area restriction is determined by the axial movement of said poppet valve and is variable by controlling said movement.

10. The fuel injector direct-operated nozzle valve control of claim 6 further including a control passage selectively communicating said low pressure fuel passage or said high pressure fuel passage to said check upper end, said control passage including a first flow area restriction for controlling the rate of fuel pressure change to said check upper end.

11. The fuel injector nozzle valve control of claim 6 wherein said first flow area restriction acts to inhibit the increase in fuel pressure to said check upper end thereby slowing movement of said check as said check moves from said closed position to said open position.

12. The fuel injector nozzle valve control of claim 6 wherein said first flow area restriction acts to retain fuel acting on said check upper end thereby slowing movement of the check as said check moves from said open position to said closed position.

13. The fuel injector nozzle valve control of claim 6 wherein varying said first flow area restriction allows for control of the check movement as said check moves between said closed position and said open position.

14. A fuel injector nozzle valve velocity control apparatus, comprising:

a housing having an injection orifice and defining a check cavity;

a check including an upper end extending into said check cavity and a lower end adjacent said injection orifice, said check being movable in response to high pressure fuel between an open position allowing high pressure fuel communication with said injection orifice and a closed position blocking said communication with said injection orifice, said check upper end dividing said check cavity into a lower check cavity and an upper check cavity;

a low pressure fuel supply;

a high pressure fuel passage communicating high pressure fuel to said check lower end and selectably communicating high pressure fuel to said lower check cavity;

a damping port allowing fuel communication between said upper check cavity and said low pressure fuel passage, said damping port including a second flow area restriction for controlling the rate of fuel pressure change within the upper check cavity thereby controlling the rate of movement of the check between its open and its closed positions; and an actuating valve for selectively controlling communication of high pressure fuel to said lower check cavity or low pressure fuel to said lower check cavity.

15. The fuel injector nozzle valve control of claim 14 wherein said damping port acts to relieve fuel pressure in said upper check cavity as said check moves from said closed position to said open position.

16. The fuel injector nozzle valve control of claim 14 wherein said second flow area restriction acts to retain fuel within said upper check cavity as said check moves from said closed position to said open position thereby increasing fuel pressure within said upper check cavity and slowing check movement between said closed position and said open position.

17. The fuel injector nozzle valve control of claim 16 wherein varying said second flow area restriction allows for control of the check movement as said check moves from said closed position to said open position.

18. The fuel injector nozzle valve control of claim 14 wherein said damping port allows low pressure fuel to enter said upper check cavity as said check moves from said open position to said closed position.

19. The fuel injector nozzle valve control of claim 18 wherein said second flow area restriction acts to inhibit low pressure fuel entering the upper check cavity thereby reducing the fuel pressure within the upper check cavity as said check moves from said open position to said closed position.

20. The fuel injector nozzle valve control of claim 19 wherein varying said second flow area restriction allows for control of the check movement as said check moves from said open position to said closed position.

21. A method of injecting fuel into a combustion chamber of an internal combustion engine using a fuel injector having an injector body, a check disposed in the injector body having a check upper end and a check lower end and movable between injecting and non-injecting positions, a spring urging the check into the non-injecting position and means for selectively communicating either high or low fluid pressures to the check ends, comprising the steps of:

(a.) controlling the communicating means to cause the high fluid pressure to be applied to the check lower end and low fluid pressure to be applied to the check upper end allowing the spring to retain the check in non-injecting position;

(b.) thereafter controlling the communicating means to cause the high fluid pressure to be applied to the upper check end while the high fluid pressure is being applied to the lower check end so that the check is moved to the injecting position against the urging of the spring; and (c.) thereafter controlling the communicating means to cause the low fluid pressure to be applied to the upper check end and high fluid pressure to be applied to the lower check end so that the check is moved to the non-injecting position in response to the urging of the spring.

22. The method of claim 21, further including the step of repeating step (b.) after step (c.).

23. The method of claim 21, wherein the step (b.) further includes the step of restricting the high fluid pressure applied to the upper check end to control the rate of movement of the check as it moves to the injecting position.

24. The method of claim 21, wherein the step (c.) further includes the step of restricting the low fluid pressure applied to the upper check end to control the rate of movement of the check as it moves from the injecting position from the non-injecting position.

25. The method of claim 21, wherein the step (b.) further includes the step of venting the upper check end to prevent hydraulic forces acting to retain the check at its non-injecting position.

26. The method of claim 25, wherein the step (b.) further includes the step of restricting the venting of the upper check to control the rate of movement of the check as it moves to the injecting position.

27. The method of claim 25, wherein the step (c.) further includes the step of restricting the venting of the check upper end to the upper check end to control the rate of movement of the check as it moves from the injecting position from the non-injecting position.

28. A direct-operated check control apparatus, comprising:

a source of high pressure fluid;

a low fluid pressure drain;

a housing having an injection orifice;

a check having a check upper end, and being movable between an open position allowing high pressure fuel communication with said injection orifice and a closed position blocking said communication with said injection orifice;

biasing means acting on said check to bias said check towards said closed position;

actuating means for controlling communication of said high pressure fluid or said low fluid pressure drain to said check upper end, thereby utilizing only said biasing means to retain the check in said closed position and utilizing only high fluid pressure to move said check to said open position.

29. The nozzle valve control apparatus of claim 28 further including a first restricting means for controlling the application of the high pressure fluid to said check upper end thereby controlling the rate said check moves from said closed position to said open position.

30. The nozzle valve control apparatus of claim 28 further including a first restricting means for controlling the application of the low fluid pressure to said check upper end thereby controlling the rate said check moves from said open position to said closed position.

31. The nozzle valve control apparatus of claim 28 further including a venting means for preventing hydraulic forces from acting on said check upper end when said check moves from said closed position to said open position.

32. The nozzle valve control apparatus of claim 31 further including a second restricting means for controlling the venting of the check upper end thereby controlling the rate said check moves from said closed position to said open position.

33. The nozzle valve control apparatus of claim 32 wherein said second restricting means controls the application of the low fluid pressure to said check upper end thereby controlling the rate said check moves from said open position to said closed position.

* * * * *